US009562755B2

(12) United States Patent
Ritchie

(10) Patent No.: US 9,562,755 B2
(45) Date of Patent: Feb. 7, 2017

(54) SAFE AND ARM MECHANISMS AND METHODS FOR EXPLOSIVE DEVICES

(75) Inventor: Robert S. Ritchie, Newhall, CA (US)

(73) Assignee: Pacific Scientific Energetic Materials Company, Valencia, CA (US)

( * ) Notice: Subject to any disclaimer, the term of this patent is extended or adjusted under 35 U.S.C. 154(b) by 0 days.

(21) Appl. No.: 13/441,160

(22) Filed: Apr. 6, 2012

(65) Prior Publication Data

US 2012/0210898 A1 Aug. 23, 2012

Related U.S. Application Data

(62) Division of application No. 12/368,214, filed on Feb. 9, 2009, now Pat. No. 8,151,708.

(60) Provisional application No. 61/027,369, filed on Feb. 8, 2008.

(51) Int. Cl.

| | |
|---|---|
| ***F42C 15/184*** | (2006.01) |
| ***F42C 15/26*** | (2006.01) |
| ***F42C 15/34*** | (2006.01) |
| ***F42C 15/00*** | (2006.01) |
| ***F42C 1/04*** | (2006.01) |
| ***F42C 15/22*** | (2006.01) |

(52) U.S. Cl.

CPC ..... *F42C 15/005* (2013.01); *F42C 1/04* (2013.01); *F42C 15/184* (2013.01); *F42C 15/22* (2013.01); *F42C 15/26* (2013.01)

(58) Field of Classification Search

CPC ..... F42C 15/24; F42C 15/26; F42C 15/34; F42C 15/00; F42C 15/184

USPC ..... 102/231, 235, 236, 237, 244, 245, 254, 102/256

See application file for complete search history.

(56) References Cited

U.S. PATENT DOCUMENTS

| | | | | |
|---|---|---|---|---|
| 1,229,669 | A | | 6/1917 | Stuart |
| 1,352,542 | A | | 9/1920 | Schneider |
| 1,585,686 | A | | 5/1926 | Pantoflicek |
| 1,648,603 | A | * | 11/1927 | Barker ..... 102/242 |
| 2,427,671 | A | * | 9/1947 | Graumann et al. ..... 102/236 |
| 2,465,395 | A | | 3/1949 | O'Rear |
| 2,537,855 | A | * | 1/1951 | Porter ..... 102/242 |
| 2,715,873 | A | | 8/1955 | Thompson |
| 2,748,707 | A | | 6/1956 | Graumann |
| 2,748,708 | A | | 6/1956 | Bertram |
| 2,870,712 | A | * | 1/1959 | Brown et al. ..... 102/210 |
| 3,103,172 | A | | 9/1963 | Hutchison et al. |
| 3,371,608 | A | | 3/1968 | Webb |
| 3,450,049 | A | * | 6/1969 | Dare ..... 102/235 |
| 3,583,321 | A | * | 6/1971 | Anderson et al. ..... 102/229 |
| 3,603,259 | A | * | 9/1971 | Webb ..... 102/235 |
| 3,608,494 | A | | 9/1971 | Ziemba |

(Continued)

*Primary Examiner* — Jonathan C Weber

(74) *Attorney, Agent, or Firm* — Perkins Coie LLP

(57) ABSTRACT

A SAFE and ARM mechanism includes an elongated casing having a first end and a second end. A high-G force firing pin is arranged relatively near to the first end and a low-G force firing pin is arranged relatively near to the second end. A detonator is arranged between the high-G force firing pin and the first end. When a G-force within a first range of magnitudes is applied to the casing along its longitudinal axis, the low-G force firing pin is displaced to strike a portion of the high-G force firing pin, and if a G-force within a second range of magnitudes is applied to the casing along its longitudinal axis, the high-G force firing pin is displaced to strike the detonator. The device may become ARMED in response to a centrifugal force generated by spinning the casing on its longitudinal axis.

16 Claims, 12 Drawing Sheets

(56) References Cited

U.S. PATENT DOCUMENTS

| | | | | | |
|---|---|---|---|---|---|
| 3,713,389 | A | | 1/1973 | Hjelm | |
| 3,730,101 | A | | 5/1973 | Schultz, Jr. | |
| 3,886,868 | A | | 6/1975 | Webb | |
| 4,013,013 | A | | 3/1977 | Davis | |
| 4,018,164 | A | * | 4/1977 | Breed et al. | 102/236 |
| 4,029,016 | A | * | 6/1977 | Cole | 102/489 |
| 4,092,927 | A | | 6/1978 | Rayle | |
| 4,160,414 | A | | 7/1979 | Stockman et al. | |
| 4,458,594 | A | * | 7/1984 | Weber et al. | 102/240 |
| 4,510,869 | A | | 4/1985 | Nicolas et al. | |
| 4,604,953 | A | | 8/1986 | Olander et al. | |
| 4,612,858 | A | | 9/1986 | Backstein et al. | |
| 4,882,995 | A | | 11/1989 | Henriksen et al. | |
| 5,243,912 | A | | 9/1993 | Ziemba | |
| 5,355,801 | A | | 10/1994 | Donahue et al. | |
| 5,591,935 | A | | 1/1997 | Shamblen et al. | |
| 5,612,505 | A | | 3/1997 | O'Brasky et al. | |
| 6,640,719 | B1 | | 11/2003 | Pacella et al. | |
| 7,343,860 | B2 | | 3/2008 | Michel et al. | |
| 7,357,081 | B2 | | 4/2008 | Zinell et al. | |
| 2008/0011179 | A1 | | 1/2008 | Michel et al. | |
| 2010/0031841 | A1 | | 2/2010 | Michel et al. | |

* cited by examiner

SAFE AND ARM MECHANISMS AND METHODS FOR EXPLOSIVE DEVICES

CROSS-REFERENCE TO RELATED APPLICATIONS

This application is a divisional of U.S. patent application Ser. No. 12/368,214, filed on Feb. 9, 2009, entitled "Safe And Arm Mechanisms And Methods For Explosive Devices," now allowed, which claims benefit under 35 U.S.C. §119 of U.S. Provisional Patent Application No. 61/027,369, filed on Feb. 8, 2008, entitled "Miniature Safe And Arm Device," both of which are incorporated herein in their entirety by reference.

TECHNICAL FIELD

The present disclosure relates generally to safe and arm mechanisms and methods for explosive devices. The present disclosure relates particularly to self-contained, all mechanical safe and arm mechanisms and methods for explosive devices.

BACKGROUND

Government safety regulations govern the specifications of military explosive devices. Among other things, current safety regulations for military explosive devices include at least the following two requirements. First, all explosive devices must be safe from inadvertent functioning in non-operational and operational environments. Second, explosive devices must be capable of self destructing either commanded or un-commanded to reduce the hazard of unexploded ordnance (UXO). Details of these requirements are contained in specifications MIL-STD-1316E, STANAG 4187 and STANAG 4404. Conventionally, certain types of explosive devices may include safe and armed (S&A) mechanisms or other types of fuzes to comply with these requirements. S&A mechanisms may include relatively simple safety mechanisms or sophisticated, programmable, target discriminating safety mechanisms.

A conventional S&A mechanism has much of its functionality controlled by sophisticated micro-electronics. These microelectronic components may detect environmental factors that affect the S&A mechanism and may select the components of the explosive device that are activated. Such conventional detecting and activation mechanisms have been used, for example, to activate explosives only upon impact of a particular type or level.

Other conventional S&A mechanisms are relatively large and are controlled by commensurately large mechanical, electro-mechanical, or electronic mechanisms. For example, such conventional S&A mechanisms may be electrically connected via a cable to remotely located controllers, sensors, power sources, and other electrical components. These S&A mechanisms have been used in explosives such as bombs, artillery shells, mines, missile warheads, and other devices that may have less stringent size and/or weight limitations.

The relatively large size and complex interconnections of these conventional S&A mechanisms tends to make them cumbersome and expensive. Explosive devices that have more stringent size and/or weight limitations cannot use such conventional S&A mechanisms, but instead require smaller, less complex and less expensive S&A mechanisms. For example, a countermine weapon for neutralizing one or more mines in a target area includes many smaller projectiles that each contains an explosive warhead. Such projectiles may be smaller even than conventional S&A mechanisms but are still required to individually comply with the safety requirements described above. Firing these countermine weapons deploys the projectiles, which spread out to cover the target area. Accordingly, it is not practical for individual projectiles to be connected with cables to a central electrical controller. Moreover, the S&A mechanisms for each projectile need to react differently in response to the type of impact, e.g., with a mine, with sand, with water, etc.

BRIEF SUMMARY OF THE INVENTION

Aspects of the present invention are generally directed toward a mechanism configured to transition an explosive device from a SAFE arrangement to an ARMED arrangement. One aspect of embodiments is directed toward a mechanism including a first firing pin, a delay primer, a second firing pin, a rotor, and a detonator. The first firing pin is configured to move along a longitudinal axis in response to a first deceleration force. The delay primer is configured to be operated by the first firing pin moving along the longitudinal axis. The delay primer is also configured to generate a pressure force at an end of a delay period. The second firing pin is configured to move along the longitudinal axis in response to at least one of the pressure force at the end of the delay period and a second deceleration force that is greater than the first deceleration force. The rotor is configured to move between first and second radial positions with respect to the longitudinal axis. The first radial position corresponds to the SAFE arrangement, and the second radial position corresponds to the ARMED arrangement. The second radial position is radially outward from the first radial position. The detonator is supported by the rotor and is configured to be operated by the second firing pin moving along the longitudinal axis when the rotor is in the second position. The detonator is also configured to be inoperable when the rotor is in the first position.

Other aspects of the present invention are generally directed toward an explosive device. One aspect of embodiments is directed toward an explosive device including a mechanism configured to transition from a SAFE arrangement of the explosive device to an ARMED arrangement of the explosive device and a fin configured to rotate the mechanism. The mechanism includes a first firing pin, a delay primer, a second firing pin, a rotor, and a detonator. The first firing pin is configured to move along a longitudinal axis in response to a first deceleration force. The delay primer is configured to be operated by the first firing pin moving along the longitudinal axis. The delay primer is also configured to generate a pressure force at an end of a delay period. The second firing pin is configured to move along the longitudinal axis in response to at least one of the pressure force at the end of the delay period and a second deceleration force that is greater than the first deceleration force. The rotor is configured to move between first and second radial positions with respect to the longitudinal axis. The first radial position corresponds to the SAFE arrangement, and the second radial position corresponds to the ARMED arrangement. The second radial position is radially outward from the first radial position. The detonator is supported by the rotor and is configured to be operated by the second firing pin moving along the longitudinal axis when the rotor is in the second position. The detonator is also configured to be inoperable when the rotor is in the first position. The fin is configured to rotate the mechanism on the longitudinal axis in response to an air stream flowing parallel to the longitudinal axis.

Yet other aspects of the present invention are generally directed toward a method of changing from a SAFE mode of an explosive device to an ARMED mode. One aspect of embodiments is directed toward a method including exposing an elongated mechanism to an air stream flowing approximately parallel to a longitudinal axis of the mechanism, imparting rotation to the mechanism on the longitudinal axis in response to the air stream, and transitioning the mechanism from a SAFE arrangement to an ARMED arrangement in response to exceeding a predetermined velocity of the air stream flow and exceeding a predetermined angular velocity of the mechanism rotation.

Additionally, a method is described for operating a safety device for an explosive apparatus. A first action is performed upon detecting an impact between the explosive apparatus and a "hard target". A second action is performed upon detecting an impact between the explosive apparatus and a "soft target". The first action may include detonating an explosive and the second action may include executing a self-destruct operation after a predetermined time interval.

Further, a SAFE & ARM (S&A) mechanism is described that includes an elongated casing or envelope having a first end and a second end. A high-G firing pin is arranged relatively near to the first end and a low-G firing pin is arranged relatively near to the second end, and a detonator is arranged between the high-G firing pin and the first end. When a G-force within a first range of magnitudes is applied to the casing along its longitudinal axis, the low-G firing pin is displaced to strike a portion of the high-G firing pin, and if a G-force within a second range of magnitudes is applied to the casing along its longitudinal axis, the high-G firing pin is displaced to strike the detonator. The device may become active in response to a centrifugal force generated by spinning the casing on its longitudinal axis.

DETAILED DESCRIPTION

A. Overview

Embodiments according to the present disclosure include various explosive devices and related safety mechanism such as a fuze or an S&A mechanism. Other embodiments according to the present disclosure further include various methods for operating the explosive devices and S&A mechanisms. Certain embodiments are designed to comply with government safety regulations such as MIL-STD-1316.

Embodiments according to the present disclosure include S&A mechanisms suitable for miniature projectile munitions where conventional S&A mechanisms are not readily implemented. For instance, certain embodiments include an S&A mechanism that is contained within has a small package, e.g., having a diameter of less than 0.75 inches and an axial length less than 2.50 inches, or a diameter of approximately 0.45 inch and an axial length of approximately 1.50 inches. Additionally, certain other embodiments of the S&A mechanisms are configured to differentiate between different types of impacts and/or to self destruct after a pre-determined time delay.

Embodiments according to the present disclosure include completely self-contained S&A mechanisms. Certain embodiments of self-contained S&A mechanisms include a completely mechanical mechanism that neither includes an electric power source nor is connected to an external electric power source.

Embodiments according to the present disclosure include S&A mechanisms that do not require any maintenance, programming, or adjustments. Certain embodiments of the S&A mechanisms use proven and DOD approved explosive components and are designed for high volume assembly. Additionally, certain other embodiments of the S&A mechanisms can be functionally tested in isolation or together with a final assembly. Some of these examples are described below and/or illustrated in the attached Figures.

Figure 1:
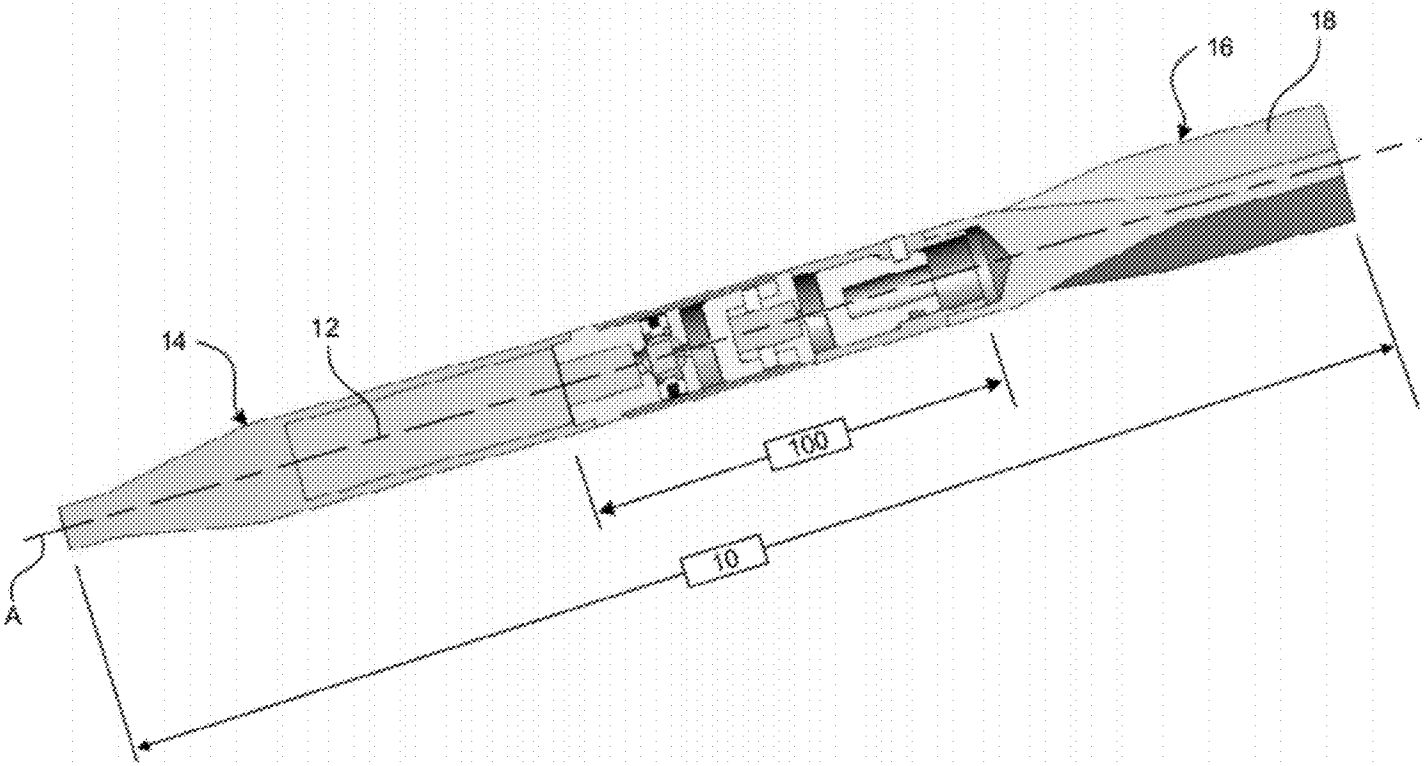
FIG. 1 is a partial cross-section view showing an explosive device including an S&A mechanism according to the present disclosure.

B. Embodiments of Safe and Arm Apparatuses and Methods for Using Such Apparatuses FIG. 1 is a partial cross-section view showing an explosive device 10 including an S&A mechanism 100 according to the present disclosure. The explosive device 10 shown in FIG. 1 can be configured as a miniature projectile that extends along a longitudinal axis A less than 10 inches and has a diameter of less than 0.75 inches, and a longitudinal length of approximately 6.5 inches and a diameter of approximately 0.44 inches. As also shown in FIG. 1, the warhead of the explosive device 10 can include an explosive pellet 12 contained in a nose section 14 that is located along the longitudinal axis A forward of the S&A mechanism 100. Certain embodiments include hermetically sealing the nose section 14 to the S&A mechanism 100, e.g., by welding, threaded connection, interference fitting, or another suitable coupling. The explosive device 10 can also include a tail assembly 16 located along the longitudinal axis A aft of the S&A mechanism 100. As is well understood, the tail assembly 16 includes a plurality of fins 18 that are configured to induce axial spin by the S&A mechanism 100 in response to longitudinal airflow along the S&A mechanism 100. For example, relative air speed of approximately 900 feet/second can induce spin of at least approximately 1,200 revolutions/minute (rpm).

The S&A mechanism 100 can provide a mid-body, structural component of the explosive device 10. Direct coupling between the S&A mechanism 100, the nose section 14, and the tail assembly 16 can at least mitigate or eliminate impact attenuation, e.g., the transmission of deceleration forces to the S&A mechanism 100 through the explosive pellet 12. The S&A mechanism 100 can have approximately the same diameter as the explosive device 10 and extend longitudinally in a range of 1.5 to 2.0 inches, and approximately 1.8 inches. The mass of the S&A mechanism 100 can be less than 45 grams, and approximately 30 grams.

Figure 2:
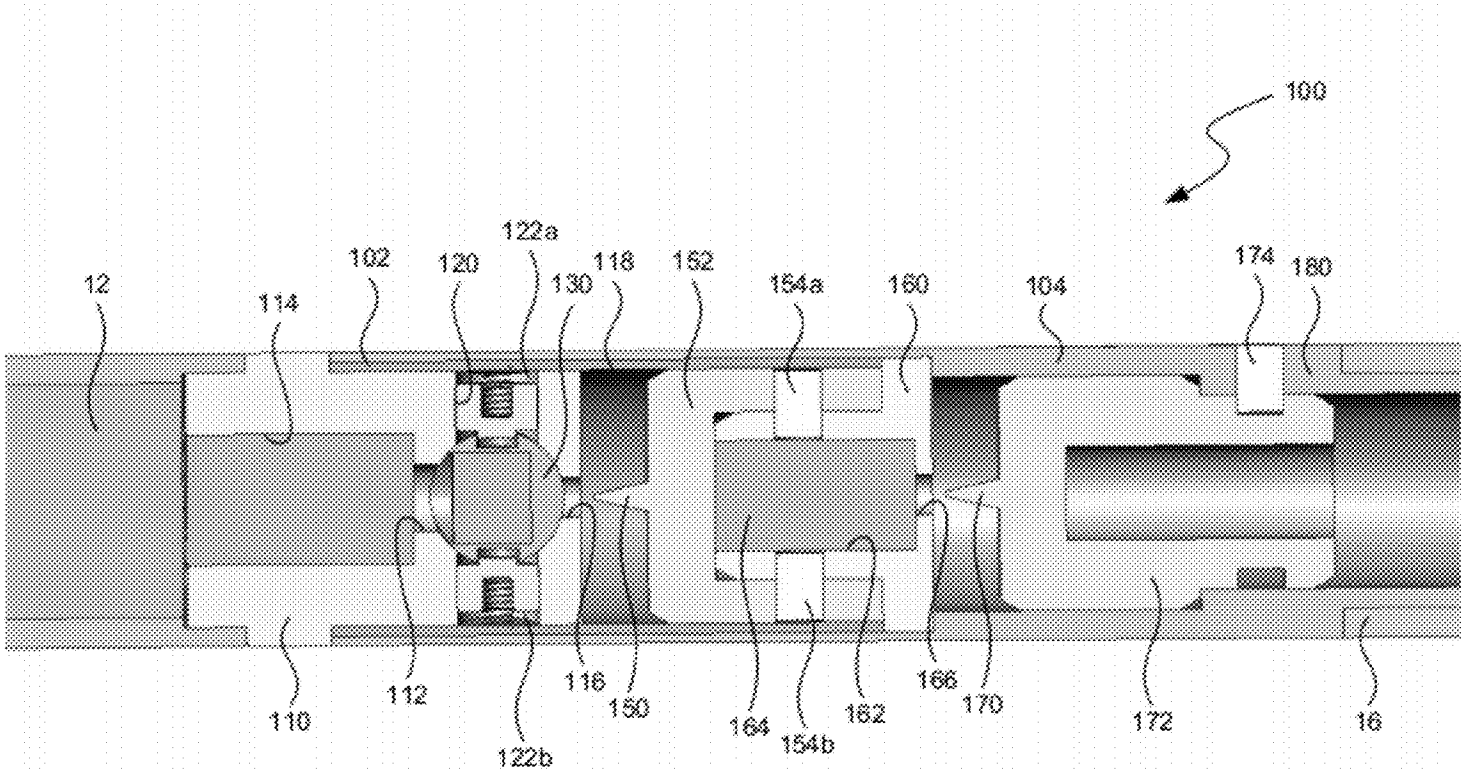
FIG. 2 is a partial cross-section view showing the S&A mechanism of FIG. 1 in a SAFE arrangement.

FIG. 2 is a partial cross-section view showing the S&A mechanism 100 in a SAFE arrangement. As shown in FIG. 2, the S&A mechanism 100 includes a lead holder 110, a rotor 130, a high-G firing pin 150, a delay primer holder 160, a low-G firing pin 170, and an aft housing 180. These features can be enclosed by a sleeve 102 and an aft sleeve 104. The sleeve 102 extends between the lead holder 110 and the delay primer holder 160. Certain embodiments of the S&A mechanism 100 can include hermetically sealing the sleeve 102 to the lead holder 110 and to the delay primer holder 160, e.g., by welding. The aft sleeve 104 extends between the delay primer holder 160 and the aft housing 180. Certain embodiments of the S&A mechanism 100 can include hermetically sealing the aft sleeve 104 to the delay primer holder 160 and to the aft housing 180, e.g., by welding. According to other embodiments, the sleeve 102 and the aft sleeve 104 can be fixed to the lead holder 110, the delay primer holder 160, and the aft housing 180 by interference fits or other suitable couplings.

The lead holder 110 can include a plurality of passages. A first passage 112 extends longitudinally between a forward lead cavity 114 and an aft high-G aperture 116 configured to receive the high-G firing pin 150. The forward lead cavity 114 houses a lead configured to igniting the explosive pellet 12. Intersecting the first passage 112 is a second passage 118 that extends transversely between interior surfaces of the sleeve 102 and is configured to guide side-to-side sliding of the rotor 130. A third passage 120 intersects the second passage 118 and defines at least one pocket 122 (pockets 122*a* and 122*b* are shown in FIG. 2) in the lead holder 110. The third passage 120 can also extend transversely between interior surfaces of the sleeve 102 or each pocket 122 can include a bottom surface (not shown) defined by the lead holder 110.

Figure 3:
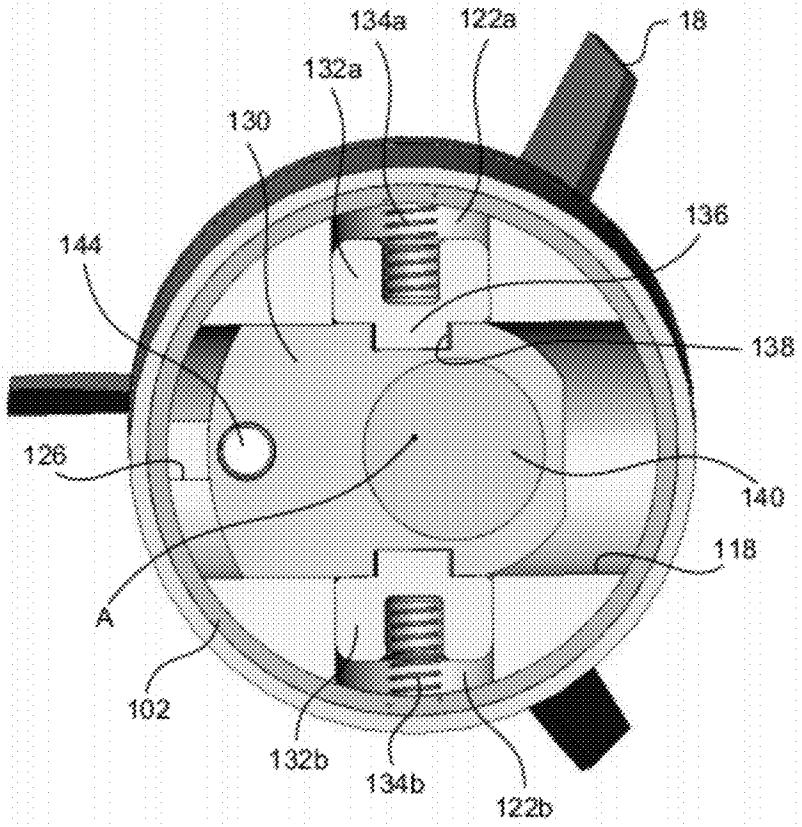
FIG. 3 is a cross-section detail view showing the S&A mechanism of FIG. 1 in a SAFE arrangement.

FIG. 3 is a partial cross-section view showing the rotor 130 in a SAFE arrangement of the S&A mechanism 100. A first revolution per minute (RPM) lock is associated with the rotor 130 and includes an individual weight 132 (weights 132*a* and 132*b* are shown in FIG. 3) disposed in each pocket 122 of the lead holder 110. Resilient members 134 (e.g., individual compression springs 134*a* and 134*b* are shown in FIG. 3) bias the weights 132 radially inward. As shown in FIGS. 2 and 3, individual resilient members 134 extend between the interior surface of the sleeve 102 and each weight 132. In the SAFE arrangement of the S&A mechanism 100, each weight 132 includes a projection 136 that engages with a recess 138 on the rotor 130. The rotor 130 supports a detonator 140 at a position that is offset with respect to the longitudinal axis A and therefore also offset with respect to the high-G aperture 116 of the lead holder 110. Accordingly, the high-G firing pin 150 does not pass through the high-G aperture 116 and does not ignite the detonator 140 in the SAFE arrangement of the S&A mechanism 100.

Referring again to FIG. 2, the high-G firing pin 150 is coupled to a first mass 152 that is configured to slide axially within the sleeve 102. Movement of the first mass 152 is restrained in the SAFE arrangement of the S&A mechanism 100 by at least one high-G shear pin 154 (individual high-G shear pins 154*a* and 154*b* are shown in FIG. 2) that couples the first mass 152 and the delay primer holder 160. Insofar as the delay primer holder 160 is fixed with respect to the sleeve 102 and the aft sleeve 104, the high-G shear pin 154 restrains movement of the first mass 152 in the SAFE arrangement of the S&A mechanism 100. Accordingly, the high-G firing pin 150 does not pass through the high-G aperture 116 and does not ignite the detonator 140 in the SAFE arrangement of the S&A mechanism 100. The high-G shear pin 154 holds the high-G firing pin 150 such that the explosive device 10 explodes only upon a suitable high-G impact. The high-G shear pin 154 is sized to shear at a predetermined level of deceleration, measured in gravitational units (G; one G of deceleration is approximately −9.8 meters/second$^2$).

As shown in FIG. 2, the delay primer holder 160 includes a cavity 162 that is configured to hold a delay primer 164. The delay primer 164 is configured to delay movement of the high-G firing pin 150 to ignite the detonator 140. Certain embodiments according to the present disclosure include a delay primer 164 configured to provide a delay period ranging from approximately zero milliseconds to approximately five minutes, and approximately 50-150 milliseconds. Thus, the delay period can allow the explosive device 10 time to complete traveling into a target, e.g., approximately 25 milliseconds or less, before exploding. Longer delay periods can require a physically larger delay primer 164, which could also elongate the explosive device 10. Other embodiments can provide other suitable delay periods in response to the type of impact by the explosive device 10. Aft of the cavity 162 is a low-G aperture 166 configured to receive the low-G firing pin 170.

The low-G firing pin 170 is coupled to a second mass 172 that is configured to slide axially within the aft sleeve 104. Movement of the second mass 172 is restrained in the SAFE arrangement of the S&A mechanism 100 by at least one low-G shear pin 174 that couples the second mass 172 and the aft housing 180. Insofar as the aft housing 180 is fixed with respect to the aft sleeve 104, the low-G shear pin 174 restrains movement of the second mass 172 in the SAFE arrangement of the S&A mechanism 100. Accordingly, the low-G firing pin 170 does not pass through the low-G aperture 166 and does not ignite the delay primer 164 in the SAFE arrangement of the S&A mechanism 100. The low-G shear pin 174 is sized to shear at a predetermined level of deceleration that is less than that required to shear the high-G shear pin 154.

Figure 4:
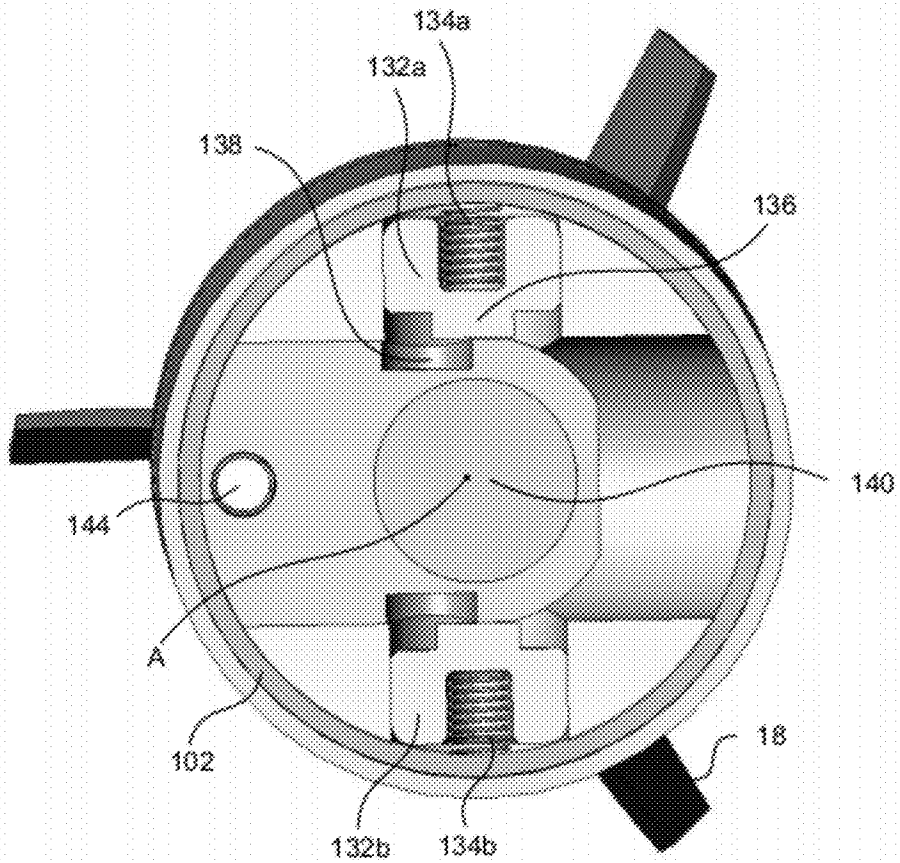
FIG. 4 is a cross-section detail view showing the S&A mechanism of FIG. 1 in an ARMED arrangement.

FIG. 4 is a cross-section detail view showing the S&A mechanism 100 in an ARMED arrangement. The S&A mechanism 100 is armed in response to launching the explosive device 10. Specifically, longitudinal air flow acting on the fins 18 causes the explosive device 10 to spin on the longitudinal axis A. A predetermined rate of axial spin by the explosive device 10 causes the weights 132 to be displaced radially outward with respect to the longitudinal axis A. Accordingly, the projections 136 disengage from the recesses 138 on the rotor 130. The axial spin also causes the rotor 130 to slide within the second passage 118 in the ARMED arrangement of the S&A mechanism 100. Certain embodiments according to the present disclosure include the rotor 130 having an asymmetrically located center of gravity configured such that the rotor 130 moves the detonator 140 into alignment with the longitudinal axis A. Accordingly, the detonator 140 is also moved into alignment with the high-G aperture 116 of the lead holder 110 in the ARMED arrangement of the S&A mechanism 100.

The RPM lock associated with the rotor 130 of the S&A mechanism 100 is configured to prevent arming in non-operational environments. As shown in FIGS. 2-4, the pockets 122*a* and 122*b* are positioned approximately 180 degrees apart around the longitudinal axis A. Thus, if the forces acting on the explosive device 10 are such that one of the weights 132, e.g., weight 132*a*, is tending to release then the opposite weight 132*b* is locking harder. Such forces could arise if, for example, the longitudinal axis A of the explosive device 10 is tumbling. The RPM lock is released by spinning of the explosive device 10 on the longitudinal axis A. After un-locking, the rotor 130 translates from the SAFE to the ARMED position such that the detonator 140 is in alignment with the high-G firing pin 150.

The explosive device 10 in the ARMED arrangement of the S&A mechanism 100 can function in two modes depending on target impact. The first mode is triggered when the explosive device 10 impacts in a soft media, e.g., misses a target. In this mode, the explosive device 10 self destructs within approximately 150 ms following impact. The second mode is triggered when the explosive device 10 impacts a hard target. In the second mode, the explosive device 10 explodes immediately upon impact. In particular, the explosive device 10 is configured to explode in response to one of high-G firing pin 150 and/or the low-G firing pin 170 moving axially along the longitudinal axis A as a result of an impact by the explosive device 10.

In both modes, the delay primer 164 is configured such that the S&A mechanism 100 will self-destruct after the predetermined delay period. The S&A mechanism is completely self-contained and can be tailored to different RPM spin rates and target characteristics, e.g., ability of the target to decelerate the explosive device 10. In addition the time delay to self-destruct operation can be selected based on the application.

Figure 5:
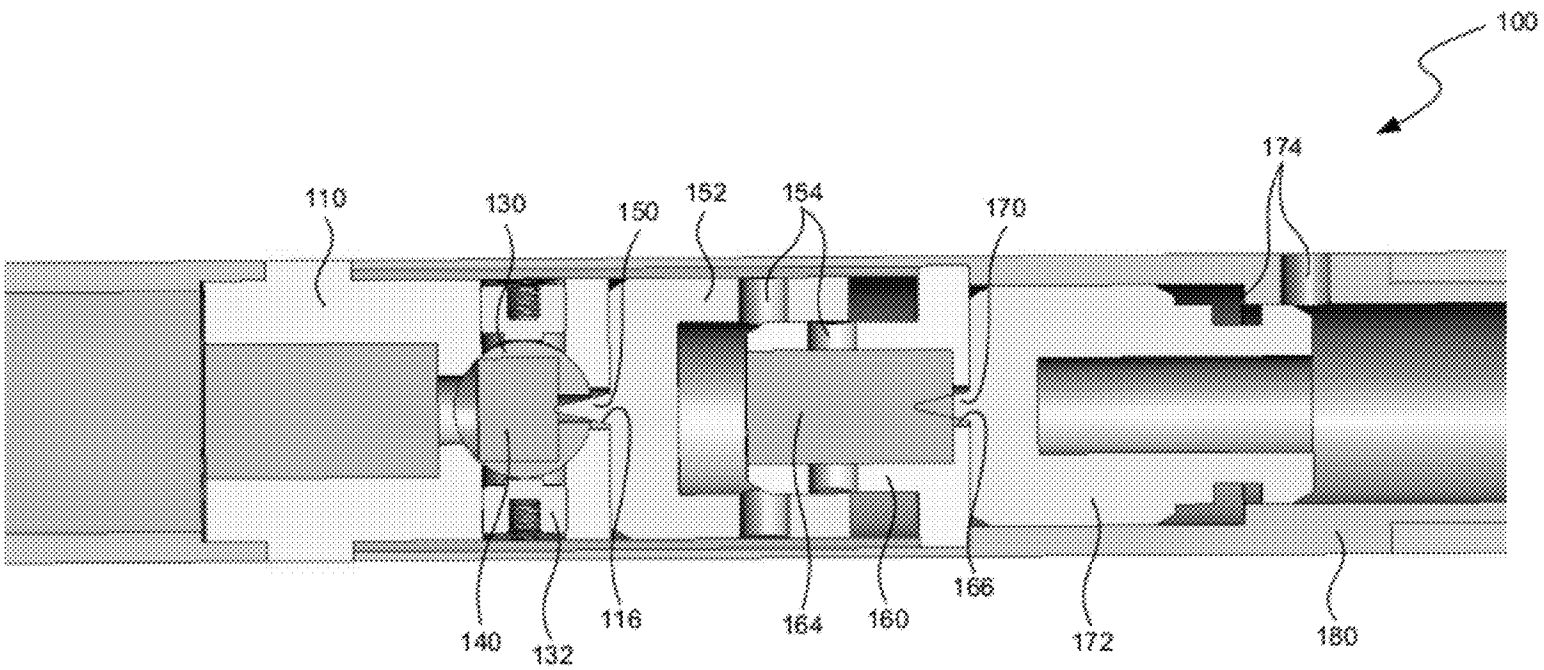
FIG. 5 is a partial cross-section view showing the S&A mechanism of FIG. 1 during a soft target impact.

FIG. 5 is a partial cross-section view showing the occurrence of the S&A mechanism 100 impacting with a hard target. Deceleration of at least approximately 20,000 G can occur when the explosive device 10 impacts a hard target, e.g., a mine. This deceleration force acting on the first mass 152 shears the high-G shear pin 154. Accordingly, the high-G firing pin 150 passes through the high-G aperture 116 and ignites the detonator 140 in the ARMED arrangement of the S&A mechanism 100. This same deceleration force also acts on the second mass 172, shearing the low-G shear pin 174. Accordingly, the low-G firing pin 170 passes through the low-G aperture 166 and ignites the delay primer 164 in the ARMED arrangement of the S&A mechanism 100.

Figure 6:
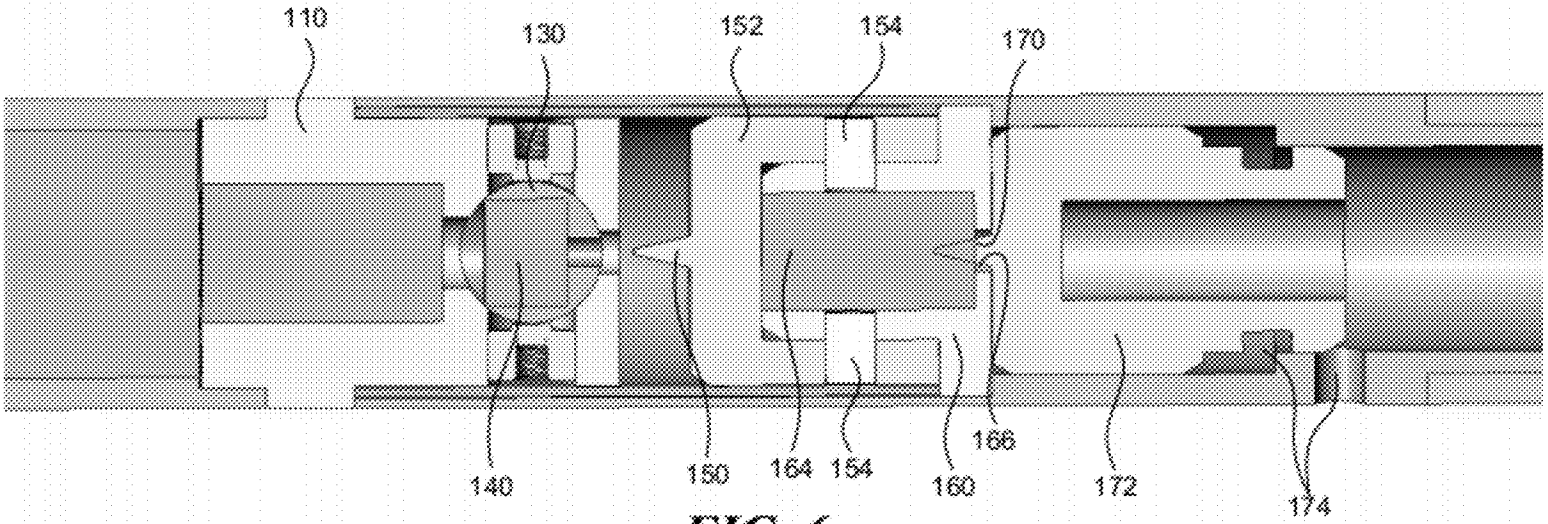
FIG. 6 is a partial cross-section view showing the S&A mechanism of FIG. 1 during a hard target impact.

FIG. 6 is a partial cross-section view showing the occurrence of the S&A mechanism 100 impacting with a soft target. Deceleration in an approximate range of 500 G to 20,000 G, and at least approximately 1,130 G, can occur when the explosive device 10 impacts a soft target, e.g., sand or water. This deceleration force acts on the second mass 172, shearing the low-G shear pin 174. This deceleration force is, however, insufficient to shear the high-G shear pin 154. The low-G firing pin 170 passes through the low-G aperture 166 and ignites the delay primer 164 in the ARMED arrangement of the S&A mechanism 100. At the end of the delay period, e.g., approximately 150 milliseconds, the burning delay primer 164 rapidly produces a pressure in the cavity 162 that is sufficient to shear the high-G shear pin 154 and to displace the high-G shear pin 154 and the first mass 152 along the longitudinal axis A. Accordingly, at the end of the delay period, the high-G firing pin 150 passes through the high-G aperture 116 and ignites the detonator 140 in the ARMED arrangement of the S&A mechanism 100.

Figure 7:
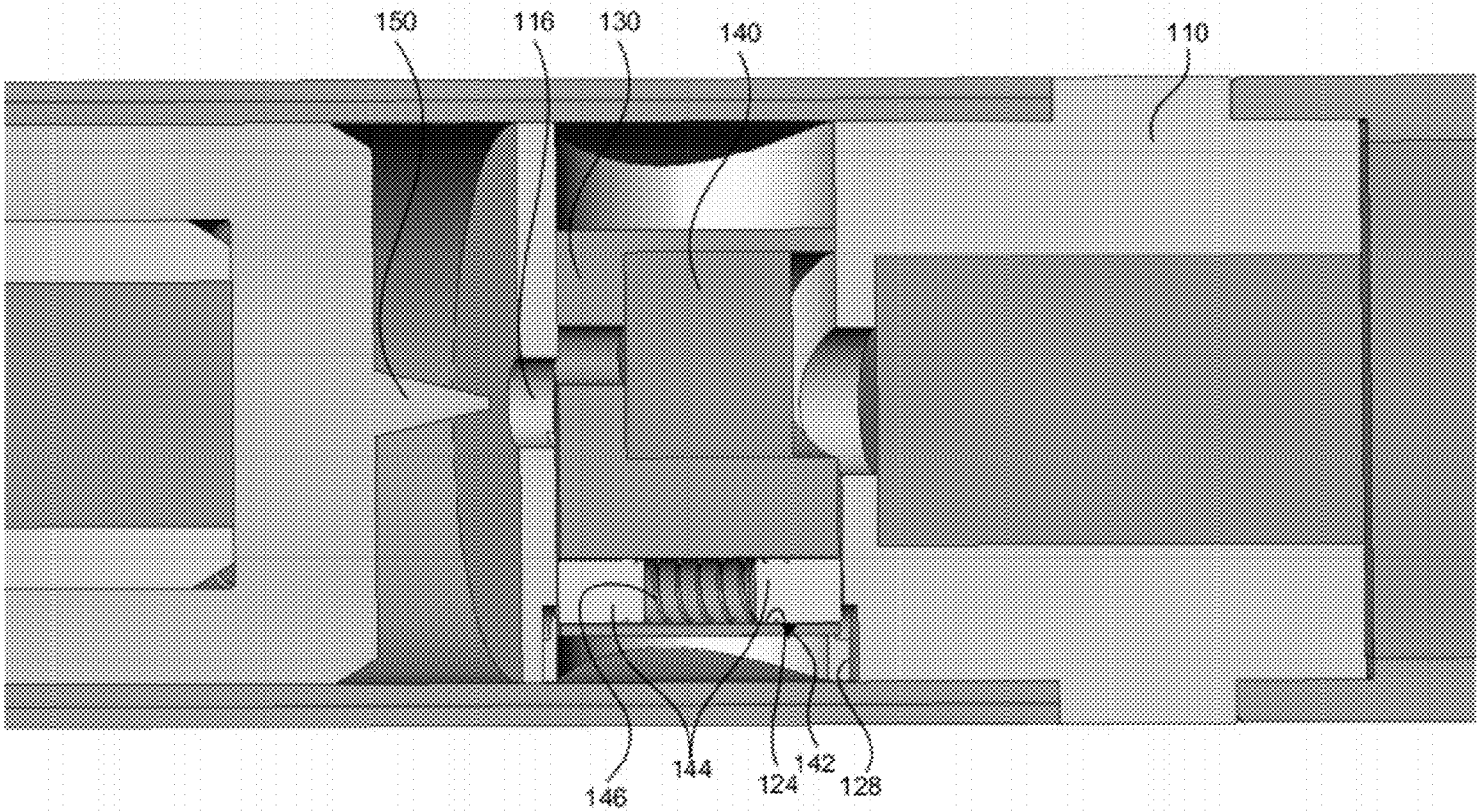
FIG. 7 is a cross-section detail view showing another S&A mechanism according to the present disclosure in a SAFE arrangement.
Figure 8:
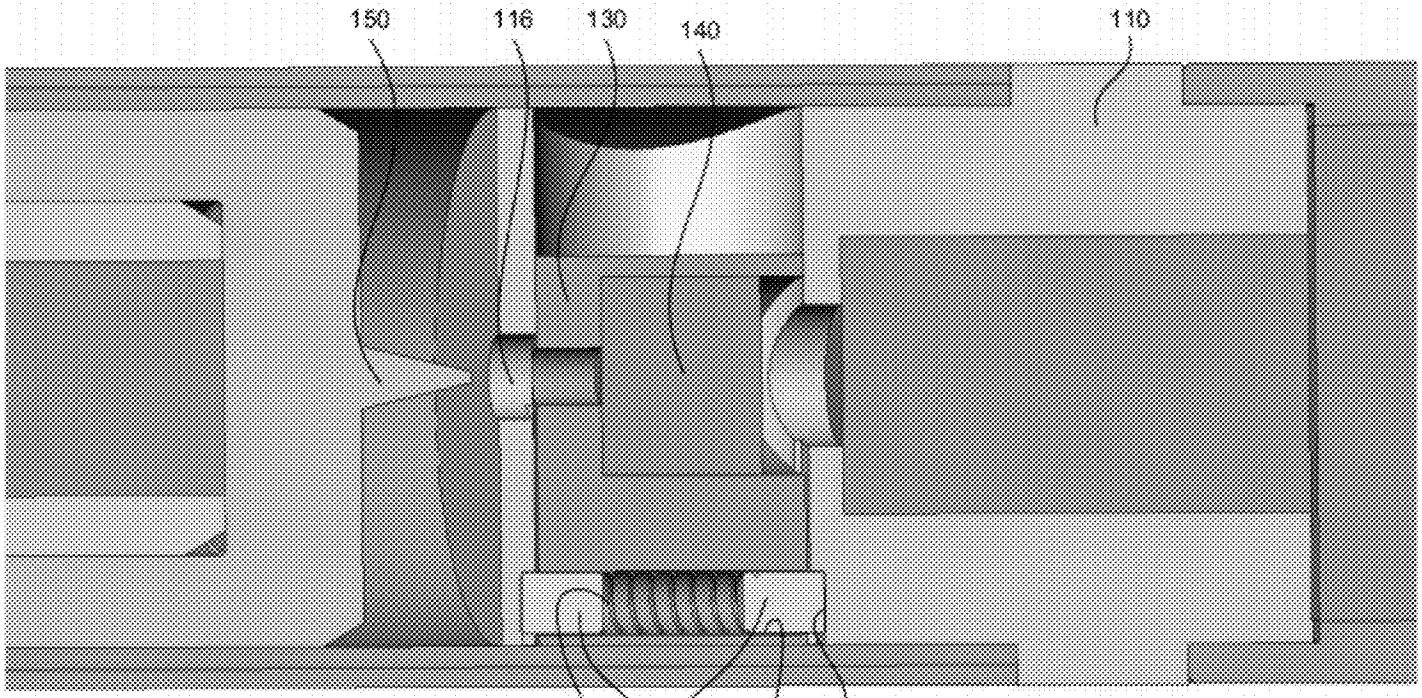
FIG. 8 is a cross-section detail view showing the S&A mechanism of FIG. 7 in an ARMED arrangement.

FIGS. 7 and 8 are cross-section detail views showing the S&A mechanism 100 additionally including a rotor arm lock 142 for the rotor 130 in the SAFE and ARMED arrangements, respectively. A fourth passage 124 extends through the rotor 130 approximately parallel to the longitudinal axis A. Positioned in the fourth passage 124 are a pair of lock pins 144 biased apart by another resilient element 146, e.g., a compression spring. In the SAFE arrangement shown in FIG. 7, outboard ends of the lock pins 144 are configured to slide in grooves 126 on interior surfaces of the second passage 118 through the lead holder 110. The lock pins 144 sliding in the grooves 126 can further guide the movement of the rotor 130 in the second passage 118. In the ARMED arrangement shown in FIG. 8, the resilient element 146 biases the lock pins 144 into counter bores 128 located at radially outward ends of the grooves 126. Accordingly, the lock pins 144 extend partially into the counter bores 128 and partially into the fourth passage 124 to lock the rotor in the ARMED arrangement and thereby prevent the rotor 130 from returning to the SAFE arrangement of the S&A mechanism 100. Generally analogous to the function of the weights 132, if a force acts on the explosive device 10 such that one of the lock pins 144 in the ARMED arrangement tends to release the rotor arm lock 142, then the other lock pin 144 is locked harder into its corresponding counter bore 128.

Figure 9:
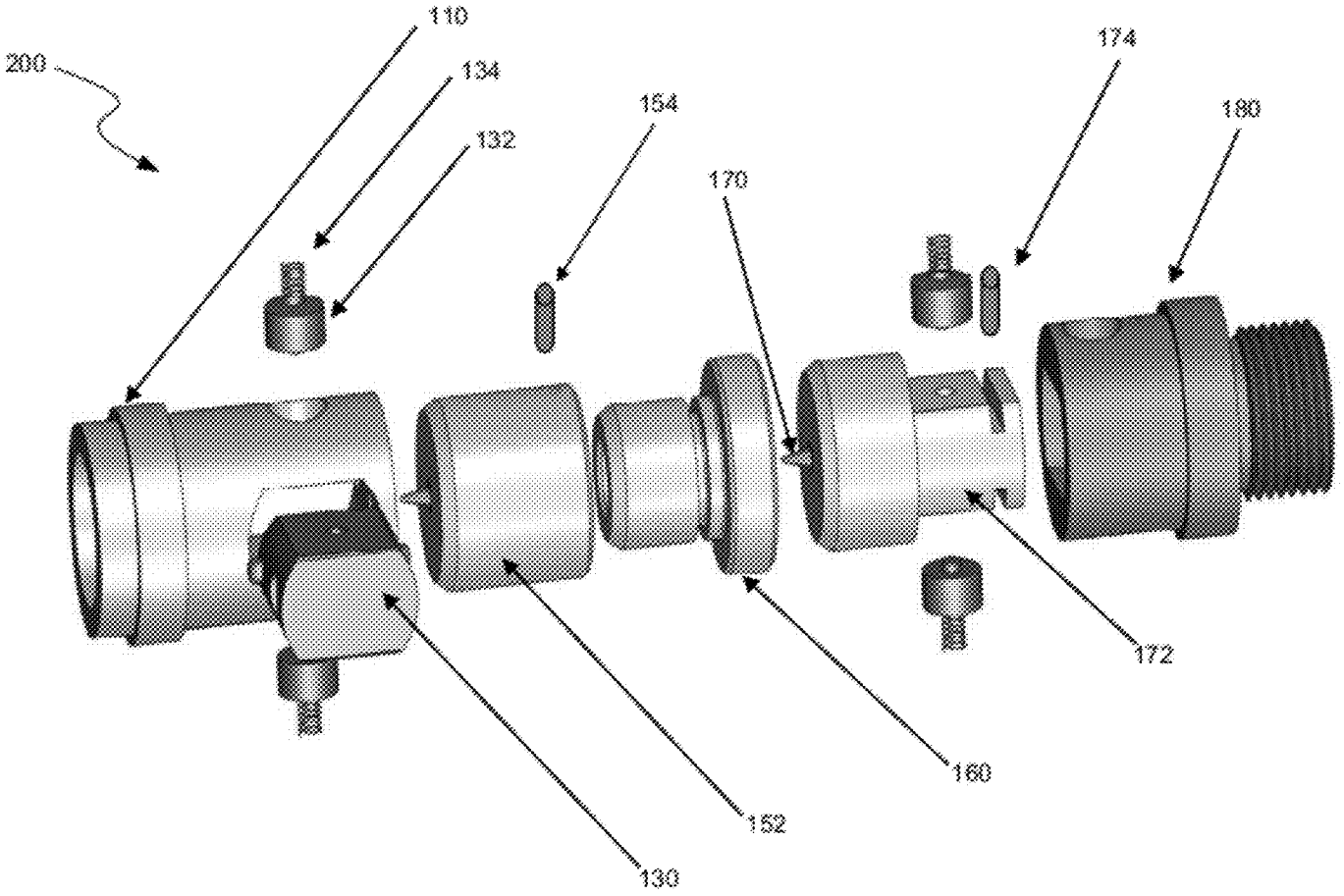
FIG. 9 is an exploded view perspective view showing yet another S&A mechanism according to the present disclosure.
Figure 10:
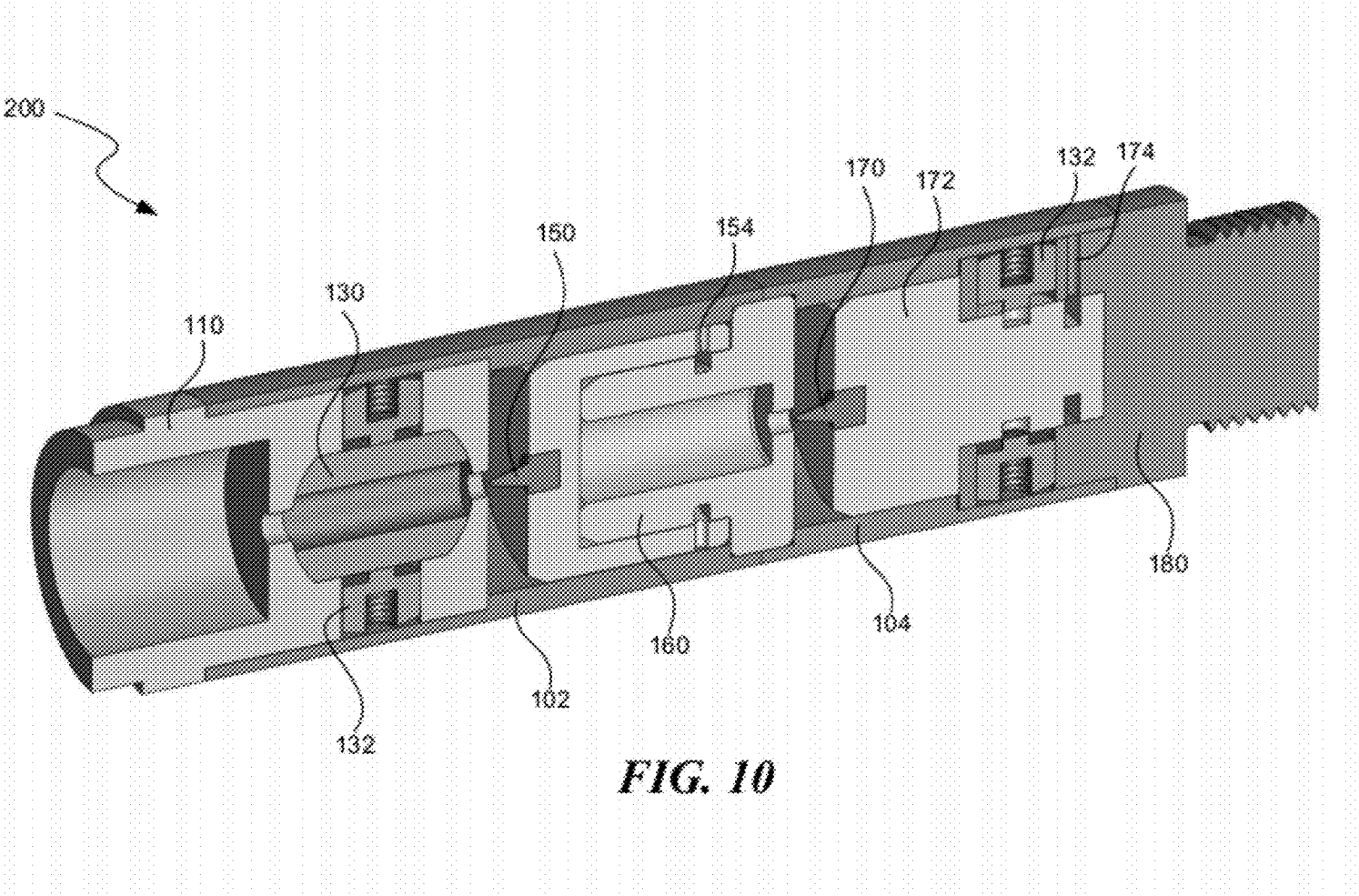
FIG. 10 is a cross-section detail view showing the S&A mechanism of FIG. 9 in an ARMED arrangement.
Figure 11:
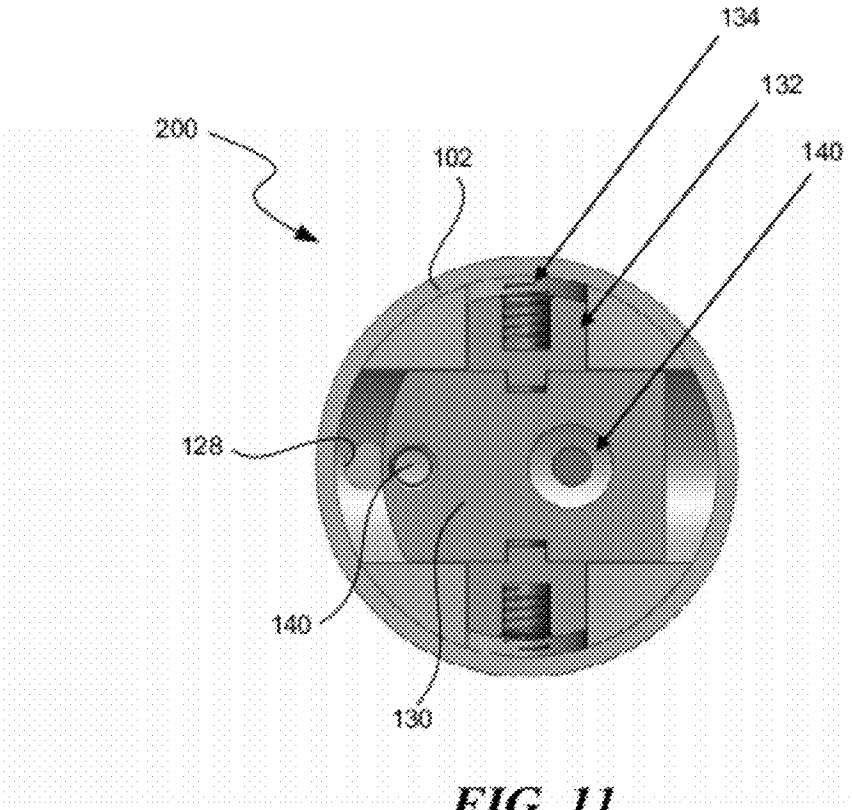
FIG. 11 is a cross-section detail view showing the S&A mechanism of FIG. 9 in a SAFE arrangement.
Figure 12:
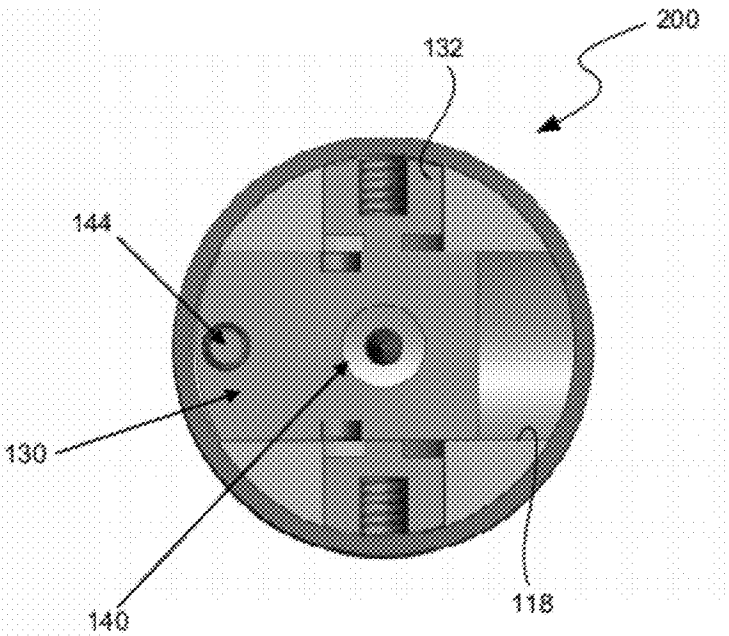
FIG. 12 is a cross-section detail view showing the S&A mechanism of FIG. 9 in an ARMED arrangement.

FIG. 9 is an exploded view perspective view showing another S&A mechanism 200 according to the present disclosure. The S&A mechanism 200 differs from the S&A mechanism 100 shown in FIG. 2 in at least two ways, otherwise generally analogous features are indicated with the same reference numbers. First, referring also to FIG. 10, the S&A mechanism 200 includes a second RPM lock that is associated with the low-G firing pin 170. Accordingly, the second RPM lock can include at least one weight 176 and at least one corresponding spring 178 that are disposed in corresponding pockets 182 of the aft housing 180. The first and second RPM locks can be actuated by the same or different spin rates of the explosive device 10 on the longitudinal axis A. Otherwise, the function of the second RPM lock can be generally analogous to that of the first RPM lock associated with the lead holder 110 and the rotor 130. Second, referring also to FIGS. 11 and 12, the size of the detonator 140 can be reduced and/or the detonator 140 can be moved further away from the longitudinal axis A in the SAFE arrangement of the S&A mechanism 100. Accordingly, the portion of the detonator 140 that is visible through the high-G aperture 116 is at least reduced in the SAFE arrangement of the S&A mechanism 200 (FIG. 11). In the ARMED arrangement of the S&A mechanism 100, as shown in FIG. 12, the detonator 140 is aligned with the longitudinal axis A.

Figure 13:
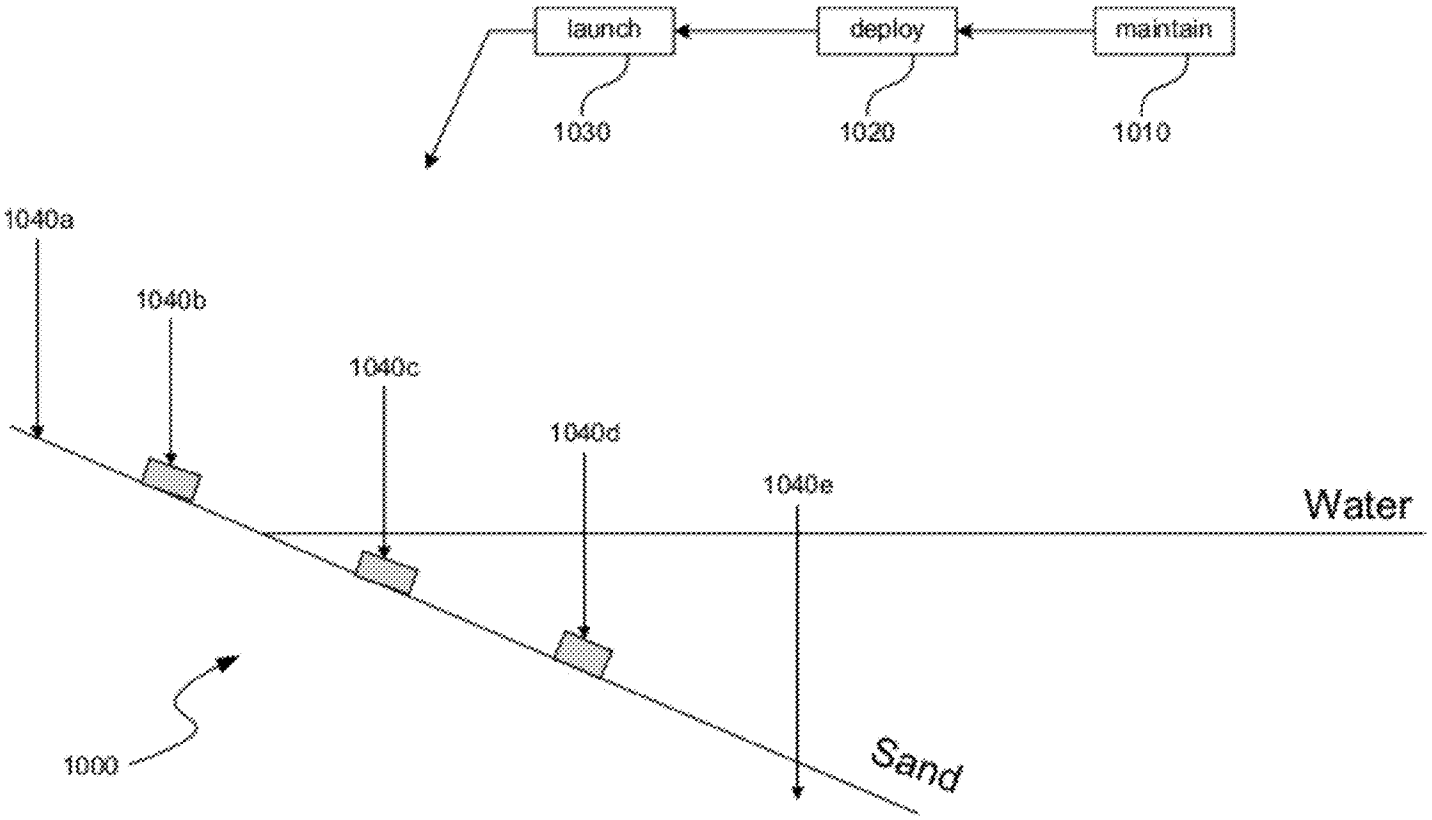
FIG. 13 is a graphical illustration explaining different types of impacts.

The operation 1000 of the explosive device 10 in general, and the S&A mechanism 100 in particular, will now be described in further detail with reference to FIG. 13. The explosive device 10 can be maintained 1010 for extended periods, e.g., a service life of 10 years or more and/or a shelf life of 20 years or more, before being deployed 1020. While the explosive device 10 is being maintained 1010, the explosive device 10 is held in an inoperative state that includes avoiding an unintended explosion as a result of dropping the explosive device 10 or as a result of vibration, e.g., during transportation. The explosive device 10 continues to be held in an inoperative state after being deployed 1020 and before being launched 1030. While the explosive device 10 is being deployed 1020, the inoperative state includes avoiding unintended explosion as a result of flight shocks or vibration, temperature shocks, and close contact with other high-G aperture 116 of the lead holder 110 explosive devices 10. When launched 1030, e.g., dispensed by a weapon containing as many as several thousand of the explosive devices 10, each S&A mechanism 100 transitions from the SAFE arrangement to the ARMED arrangement while avoiding unintended explosion as a result of launch shock, set-back acceleration, and angular acceleration. For example, this transition from the SAFE arrangement to the ARMED arrangement can occur in less than one second and approximately 600 milliseconds in response to the explosive device 10 achieving a predetermined velocity, e.g., 900 feet/second, and a predetermined spin, e.g., 1250 rpms. Flight time of the explosive devices 10 after being dispensed from the weapon can be approximately several seconds or less until impact 1040. The impact 1040 can occur in several different circumstances. According to a first circumstance 1040*a*, the explosive device 10 strikes generally solid ground but misses a mine. The impact force of the explosive device 10 in the first circumstance 1040*a* can be in an approximate range of 4,030 G to 8,000 G. According to a second circumstance 1040*b*, the explosive device 10 strikes a mine on/in the ground. The impact force of the explosive device 10 in the second circumstance 1040*b* can be in an approximate range of 20,000 G to 67,000 G. According to third and fourth circumstances 1040*c* and 1040*d*, the explosive device 10 strikes a mine located in shallow or deep water, respectively. The impact force of the explosive device 10 in the third and fourth circumstances 1040*c* and 1040*d* can be at least approximately 1,130 G. According to a fifth circumstance 1040*e*, the explosive device 10 enters water and strikes the seabed but misses a mine. The impact force of the explosive device 10 in the fifth circumstance 1040*e* can be in an approximate range of 1,130 G to 4,030 G. In general, the time between impact 1040 and the momentum of the explosive device 10 being halted can be approximately 25 milliseconds. If the explosive device 10 does not strike a mine, e.g., as in the first and fifth circumstances, the explosive device 10 self destructs after the delay period, e.g., 150 milliseconds, thereby avoiding the explosive device 10 becoming unexploded ordnance.

Certain embodiments according to the present disclosure provide a variety of features and advantages as will now be described. Prior to dispensing from the weapon, the rotor containing the detonator is held SAFE and out of line with an RPM lock. After dispensing from the weapon, each explosive device enters the wind stream and spins up to a minimum rpm, whereupon the RPM lock(s) and the rotor are unlocked, and the rotor moves to the ARMED arrangement. When the rotor is positioned in the ARMED arrangement, the firing pin is aligned with the detonator. The S&A mechanism may comprise rotor arm locks that can only be activated in the operating environments. Thus, the S&A mechanism may include a rotor arm lock for preventing rotor bounce between ARMED and SAFE arrangements. The rotor arm locks provide robust safety features for both the SAFE and ARMED arrangements. The transition from SAFE to ARMED takes place at a within a specified environment, is prompt, and permanent.

Certain embodiments in accordance with the present disclosure include redundant and opposing detents or RPM locks. The RPM locks can include two opposing, lightly loaded pins to hold a rotational member in place under severe shock and vibration conditions. The opposing pins insure positive retaining force by at least one pin regardless of the direction or axis of the external force. This also eliminates any required rotational orientation of the internal components of the S&A mechanism.

The S&A mechanism is responsive to environmental exposures and provides target discrimination. Certain embodiments according to the present disclosure include at least one shear pin capable of discriminating between "hard" and "soft" targets. Upon impact with a soft target, the low-G shear pin fails allowing the low-G firing pin to initiate a time delay primer. Depending on the impact media, the explosive device may continue to travel for approximately 20-25 milliseconds. If the explosive device has not impacted a hard target, the delay primer output pressurizes the high-G firing pin after a time delay, striking the detonator and igniting the explosive lead and warhead explosive. Upon impact with a hard target, both the low-G shear pin and the high-G shear pins fail. The detonator is initiated approximately 100-400 microseconds after impact for destroying the target. The delay primer may continue to burn until the time delay expires. The discriminating feature of the S&A mechanism is repeatable and reliable to provide each target type with the appropriate function time, which can be different for each target.

Certain embodiments according to the present disclosure include a self-contained, all mechanical S&A mechanism that responds to specific environmental exposures and provides target discriminating in a small package, e.g., approximately 0.5 inches diameter and 6.5 inches length. Accordingly, an explosive device having a miniature warhead coupled to an S&A mechanism is capable of discriminating between different levels of impacts. The explosive devices may be configured to meet the requirements of MIL-STD-1316. Further, the S&A mechanism is self-contained and operates without input from an external power supply and there are no external connections. Additionally, the S&A mechanism functions with two separate and independent external environments. In some embodiments, the S&A mechanism does not rely on "stored energy" devices.

Certain embodiments in accordance with the present disclosure are configured to mechanically discriminate between hard and soft targets with a low piece part count that simplifies assembly steps and reduces component costs. Neither electrical connections nor an external power source is required. A stainless steel exterior and hermetically sealed welded construction provide extended service and shelf life. Additionally, embodiments in accordance with the present disclosure comply with MIL-STD-1316 and are resistant to HERO or E3 due to an enclosed Faraday shield.

The S&A mechanism may be contained in a very small envelope including a welded metal construction that is hermetically sealed to prevent corrosion, moisture intrusion and loss of operation capability. The S&A mechanism may also be configured to protect against susceptibility to HERO or EMI, EMC radiation. The explosive devices comprise all U.S. Department of Defense approved explosives.

The explosive devices also self-destruct after a time delay. The probability of an individual explosive device impacting a mine is low. Therefore the majority of the explosive devices must self-destruct to reduce or eliminate the presence of unexploded ordnance. This self-destruct feature is initiated after the ARMED arrangement occurs, and is accomplished whether or not the explosive device impacts a mine.

Certain embodiments according to the present disclosure can include some or all of the following components of the S&A mechanism. The S&A mechanism can include three subassemblies contained in two outer sleeves. These three subassemblies can include a low-G firing pin subassembly, a high-G firing pin subassembly, and a rotor and initiation subassembly. The low-G firing pin subassembly can include the aft housing, the low-G firing pin, the low-C shear pin, an RPM lock and the aft sleeve. The high-G firing pin sub assembly, or S&A mechanism mid-body, can include the high-G firing pin, the delay primer holder, the delay primer, and the high-G shear pin. The rotor and initiation subassembly can include the lead holder, the rotor, the detonator, another RPM lock, the rotor arm lock, and the explosive lead.

The lead holder can include the explosive lead, portions of an RPM lock, and portions of a rotor arm lock. The explosive lead can include an approved explosive (e.g., $CH_6$) to transfer detonation from the detonator to the warhead explosive. The explosive lead can be pressed and sealed in a metal cup. The RPM lock for the rotor can include opposing, high density (e.g., tungsten) pins, nominal biased by resilient members that have a spring rate which will be overcome at a predetermined spin rate of the explosive device. Opposing pins ensure there is at least one pin engaging the rotor during all non-operating shock or vibration. The rotor can contain the detonator, e.g., a stab detonator, and portions of the rotor arm lock. The rotor arm lock can include two locking pins located in the rotor and biased apart by another resilient element, e.g., one or more springs. When the rotor reaches the end of its ravel in the ARMED arrangement, the pins are pushed into a counter bore in the lead holder, thereby locking the rotor in the ARMED arrangement and preventing bouncing of the rotor between the ARMED and SAFE arrangements. The detonator or stab detonator comprises an explosive initiator and is contained in the rotor. The high-G firing pin strikes the detonator to initiate ignition of the explosive lead. The high-G firing pin is held in place by one or more shear pins in the SAFE arrangement. The high-G shear pins can be made from extruded aluminum wire with low elongation mechanical properties. When subjected to a predetermined deceleration force, the mass of the body connected with the high-G firing pin will shear the high-G shear pins, and the high-G firing pin will strike the detonator with sufficient energy to initiate the detonator. The high-G firing pin surrounds the delay primer holder in a telescopic relationship and can be made from stainless steel. The delay primer holder contains the delay primer, which is the first to function in the low g impact mode, and causes the high-G firing pin to strike the detonator. After a specified time delay, the delay primer provides a source of gas pressure sufficient to shear the high-G shear pins and move the high-G firing pin to initiate the detonator. The low-G firing pin is coupled to a mass that shears the low-G shear pin to initiate the delay primer. The low-G firing pin is held in place by one or more low-G shear pins sized to release the low-G firing pin at the first and least impact level, i.e., less than that required to shear the high-G shear pins. Individual low-G shear pins can be made from extruded aluminum wire having low elongation mechanical properties. The low-G firing pin can additionally be held in place by an RPM lock in the SAFE arrangement. The outside surface of the low-G firing pin can be dry film lubricated to smoothly slide in the aft outer sleeve. An aft housing can be a stainless steel component that connects to the tail assembly and includes the low-G shear pin and the RPM lock associated with the low G firing pin. After the components that make up the low-G firing pin sub-assembly are installed, the aft housing is welded to the aft sleeve. The outer sleeves can be welded to the lead holder and aft housing. The outer sleeves can position and encase the internal components of the S&A mechanism.

The high-G firing pin and the low-G firing pin can be approximately identical stainless steel firing pins. Features of the firing pins are promulgated for firing stab initiated devices and can include an outer diameter that is knurled and pressed into the respective firing pin bodies.

Weights for the RPM locks and the pins for the rotor arm lock can be made from Tungsten alloy and dry film lubricated. The weights hold the firing pins in place and protect the shear pins until a minimum rpm is achieved at which time the RPM locks disengage from the firing pin. All of the weights in the RPM locks can be identical and operate at the same parameters. Springs for the RPM locks can be sized to release the RPM weights at a specified spin rpm. The springs can be fabricated from stainless steel.

Certain embodiments according to the present disclosure operate according to a method that includes some or all of the following steps. The S&A mechanism is maintained in the SAFE arrangement under all environmental conditions unless two environmental conditions occur in order. First, the explosive device must encounter a minimum air speed, e.g., 900 feet/second. This environment imparts a rotation to the explosive device via canted fins of the tail assembly. Second, the explosive device must achieve a minimum spin of 1,200 rpm. This spin causes the weights of the RPM locks to retract against the springs of the RPM locks. This unlocks the rotor, which moves to align and lock the detonator in the ARMED arrangement. A first impact with either a hard target (e.g., a mine) or a soft target (e.g., water and sand) initiates a pyrotechnic sequence. The explosive devices that impact a hard target detonate approximately immediately, and the explosive devices that impact a soft target (mine) detonate after a time delay (e.g., 50-150 milliseconds). The impact forces required to initiate one of the pyrotechnic sequences can be at least approximately 1,130 G for a soft target and at least approximately 20,000 G for a hard target.

Other methods according to the present disclosure can include (1) at least one explosive device being launched into a minimum velocity air stream, e.g., approximately 900 ft/sec; (2) the air stream reacting with the canted tail fin causing rotation of the explosive device; (3) the explosive device spinning at a minimum speed, e.g., approximately 12,000 rpm; (4) retracting the RPM locks due to centrifugal force and disengaging at an intermediate speed, e.g., approximately 9,000 rpm; and (5) moving the rotor with the detonator from the SAFE arrangement to the ARMED arrangement and locking the rotor in the ARMED arrangement. If the explosive device impacts a soft target causing at least approximately 900 G of deceleration, shearing the low-G shear pins and initiating the delay primer with the low-G firing pin. If the explosive device impacts a hard target causing at least approximately 20,000 G of deceleration, shearing the high-G shear pins and initiating the detonator with the high-G firing pin. If the explosive device does not impact a hard target, pressurizing the high-G firing pin with the delay primer, shearing the high-G shear pins, and initiating the detonator with the high-G firing pin. All explosive devices launched into the air stream will self-destruct within 150 milliseconds of their impact, regardless of the impact type.

C. Alternative Embodiments or Features

From the foregoing, it will be appreciated that specific embodiments of the disclosure have been described herein for purposes of illustration, but that various modifications can be made without deviating from the spirit and scope of the disclosure. For example, the S&A mechanisms and related concepts presented in this disclosure can be used in applications other than those discussed above. For instance, some techniques used in the disclosed S&A mechanisms can be used in various platforms that spin or do not spin. Some techniques could be used in small caliber projectiles that spin due to rifling, small rocket motors that use canted nozzles or thrust motors to spin. The opposing locking feature could also be released by non-spinning action, such as a spring loaded band, sliding ban or simple released such as bore riders. The discriminating initiation feature can be tailored to different targets by adjustment of the firing pin mass and shear pin strength. The self destruct time is a function of the time delay primer which can be micro seconds to several seconds to several minutes. Moreover, specific elements of any of the foregoing embodiments can be combined or substituted for elements in other embodiments. Furthermore, while advantages associated with certain embodiments of the disclosure have been described in the context of these embodiments, other embodiments may also exhibit such advantages, and not all embodiments need necessarily exhibit such advantages to fall within the scope of the invention. Accordingly, embodiments of the disclosure are not limited except as by the appended claims.

I claim:

1. A method of controlling an explosive device, comprising:

sliding a rotor in a direction generally perpendicular to a trajectory of the explosive device;

moving a lock in the mechanism in the direction generally perpendicular to the trajectory of the explosive device in response to a centrifugal force, wherein the lock includes lock pins;

extending the lock pins of the lock in a direction generally parallel to the trajectory of the explosive device to engage with the rotor and to transition the mechanism from a SAFE arrangement to an ARMED arrangement; and moving a first firing pin in response to a first deceleration force.

2. The method of claim 1, further comprising:

moving a second firing pin in response to a second deceleration force that is greater than the first deceleration force, wherein the explosive device includes a nose section, an explosive pellet, and a tail assembly, and wherein the first firing pin and the second firing pin are positioned between the explosive pellet and the tail assembly.

3. The method of claim 2, further comprising:

igniting a delay primer in response to moving the first firing pin; and moving a second firing pin in response to igniting the delay primer.

4. The method of claim 2 wherein engaging the lock fixes a rotor in a radial position such that an axis of the second firing pin is generally aligned with an axis of a detonator.

5. The method of claim 2 wherein moving the first firing pin is enabled by shearing a first shear pin and moving the second firing pin is enabled by shearing a second shear pin having higher shear resistance than the first shear pin.

6. The method of claim 2 wherein the first firing pin and the second firing pin move along a longitudinal axis.

7. The method of claim 2, further comprising igniting a detonator in response to moving the second firing pin.

8. The method of claim 7, further comprising igniting an explosive pellet in response to igniting the detonator.

9. The method of claim 1, further comprising executing a first detonation delay for a hard target or a second detonation delay for a soft target, wherein the first detonation delay is shorter than the second detonation delay.

10. The method of claim 1 further comprising releasing a first lock in a mechanism in response to a centrifugal force which enables the rotor to move before the rotor is slid in a generally perpendicular direction.

11. The method of claim 10, further comprising:

moving a second firing pin in response to a second deceleration force that is greater than the first deceleration force, wherein the explosive device includes a nose section, an explosive pellet, and a tail assembly, and wherein the first firing pin and the second firing pin are positioned between the explosive pellet and the tail assembly.

12. The method of claim 11, further comprising:

igniting a delay primer in response to moving the first firing pin; and moving a second firing pin in response to igniting the delay primer.

13. The method of claim 11 wherein engaging the lock fixes a rotor in a radial position such that an axis of the second firing pin is generally aligned with an axis of a detonator.

14. The method of claim 11 wherein moving the first firing pin is enabled by shearing a first shear pin and moving the second firing pin is enabled by shearing a second shear pin having higher shear resistance than the first shear pin.

15. The method of claim 11 wherein the first firing pin and the second firing pin move along a longitudinal axis.

16. The method of claim 11, further comprising igniting a detonator in response to moving the second firing pin.

* * * * *